United States Patent [19]

Catta

[11] Patent Number: 4,836,625

[45] Date of Patent: Jun. 6, 1989

[54] CONSOLE STRUCTURE

[75] Inventor: David Catta, Calgary, Canada

[73] Assignee: 221241 Alberta Ltd., Calgary, Canada

[21] Appl. No.: 77,237

[22] Filed: Jul. 24, 1987

[30] Foreign Application Priority Data

Apr. 13, 1987 [CA] Canada ..... 534590

[51] Int. Cl.[4] ..... A47B 48/00

[52] U.S. Cl. ..... 312/257 SK; 312/7.2

[58] Field of Search ..... 312/257 R, 257 SK, 263, 312/257 SM, 108, 7.2, 140, 264

[56] References Cited

U.S. PATENT DOCUMENTS

| | | | |
|---|---|---|---|
| 2,380,379 | 7/1945 | Attwood | 312/257 R |
| 3,265,455 | 8/1966 | Ferdinand et al. | 312/257 R |
| 3,565,502 | 2/1971 | Bracy et al. | 312/257 R |
| 3,598,464 | 8/1971 | Moroziuk | 312/257 R |
| 3,820,299 | 6/1974 | Verholt | 312/257 R |
| 4,017,134 | 4/1977 | Lenglin et al. | 312/257 SK |
| 4,126,364 | 11/1978 | Reilly | 312/263 X |
| 4,586,759 | 5/1986 | Wrobel | 312/257 R |

FOREIGN PATENT DOCUMENTS

| | | | |
|---|---|---|---|
| 2180741 | 4/1987 | United Kingdom | 312/252 |

OTHER PUBLICATIONS

Widney Dorlec 20/30 System Brochures (undated).

*Primary Examiner*—Joseph Falk
*Attorney, Agent, or Firm*—Philip Furgang

[57] ABSTRACT

There is described a console structure for supporting one or more pieces of equipment, comprising a plurality of horizontally-spaced, vertically upright gable members defining therebetween a cavity within which at least some of the pieces of equipment may be supported, stringer means interconnecting the gable members to provide a self-supporting structure, the stringer means including therein at least one continuous longitudinally extending slot adapted for connection to fastening means joining the stringer means to the gable members, and means for supporting the pieces of equipment within the cavity.

30 Claims, 10 Drawing Sheets

CONSOLE STRUCTURE

BACKGROUND OF THE INVENTION

The present invention relates to framework for supporting different pieces of workstation equipment, and more particularly to a console structure for supporting electronic equipment in the nature of computers, video monitors, control panel and the like.

Control consoles of the type described herein generally include a framework for receiving and supporting the necessary pieces of electronic and support equipment including terminals, monitors, keyboards, switch panels, telephone turrets, lighting and so forth, and a planar work surface extending outwardly from the framework at a convenient height. Some of the equipment including video monitors and output displays is supported above or at least to be visible above the work surface for convenient viewing and user access. Attractive finishing panels are also usually supported by the basic framework.

To date, many workstation consoles have been custom manufactured which in terms of design and construction is both expensive and time consuming. This approach has been necessitated by customer requirements that are often unique in terms of workstation size, equipment placement, human engineering and cost considerations. In the result, the completed console structures are not only extremely expensive, but are also difficult if not impossible to subsequently modify for the reconfiguration of existing equipment or to retrofit new equipment.

An alternative approach has been to assemble the consoles from fixed size modular sections. Although in some instances this approach can reduce costs, the consoles nevertheless suffer from the same limitations with respect to subsequent modifications and reconfiguration of equipment within the console.

A need therefore exists for a console structure which overcomes the problems inherent in either the custom design and manufacture or modular assembly of console structures.

SUMMARY OF THE INVENTION

It is an object of the present invention to provide a console structure comprising a relatively few basic components which can be easily assembled into a supporting framework for a wide variety of different console structures and shapes without major modifications to the basic components themselves.

It is a further object of the present invention to provide a console framework providing as much unimpeded space therein as possible to maximize the adaptability of the framework for the mounting of different pieces of equipment at different locations, and the ability to change the layout without having to wholly rebuild the framework or substantially modify outside panel treatments.

According to the present invention then, there is provided a console structure for supporting one or more pieces of equipment, comprising a plurality of horizontally-spaced, vertically upright gable members defining therebetween a cavity within which at least some of the pieces of equipment may be supported, stringer means interconnecting the gable members to provide a self-supporting structure, the stringer means including therein at least one continuous longitudinally extending slot adapted for connection to fastening means joining the stringer means to the gable members, and means for supporting the pieces of equipment within the cavity.

According to a further aspect of the present invention, there is also provided a connecting member for interconnecting one structural member to another, comprising an elongated stringer having therein at least one slot extending the length of the stringer, the slot being adapted to receive therein fastening means joining the stringer to the structural members.

BRIEF DESCRIPTION OF THE DRAWINGS

Embodiments of the invention will now be described in greater detail, and will be better understood when read in conjunction with the following drawings in which.

DETAILED DESCRIPTION OF THE PREFERRED EMBODIMENTS

Figure 1:
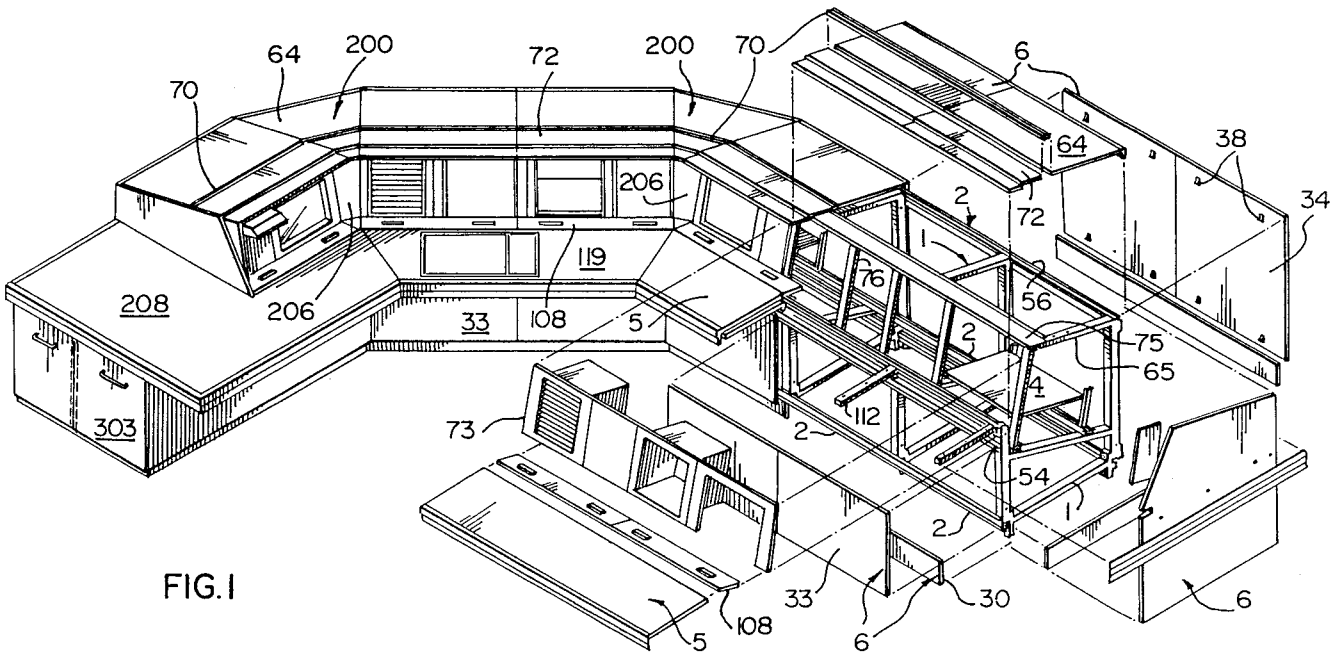
FIG. 1 is a perspective, partially exploded view of a console structure in accordance with the present invention.

With reference to FIG. 1, there is shown a typical console supporting various pieces of computer hardware, lighting fixtures and other pieces of equipment. Not all consoles of course are adapted or required to support computers or computer-controlled equipment but as this is perhaps the most common use for such consoles, reference will be made to this particular use for purposes of description.

The types of equipment to be supported by the console will vary tremendously. The console structure must be adaptable to support all of these different pieces of equipment, at locations specified by the customer.

With reference to FIG. 1, the basic elements of the console structure in accordance with the present invention include a plurality of horizontally spaced, vertically upright gable members 1 interconnected by a variety of stringers generally indicated at 2 to provide a rigid framework. As will be described hereinafter in greater detail, the stringers 2 perform a variety of functions.

The framework also includes adjustable platforms 4 for supporting monitors and similar equipment within the console, a horizontal work surface 5 and external finishing panels generally indicated at 6.

As aforesaid, the gables are interconnected by a number of stringers 2. The stringers in addition to connecting adjacent gables together perform a variety of other functions including supporting the finishing panels and the horizontal work surface and are therefore formed in a variety of different shapes depending upon their placement and use as will be described below. It is important however for purposes of maintaining maximum flexibility of assembly that the stringers not require custom machining (i.e. drilling of holes) to accommodate for example different or variable spacings between adjacent gables, or in the making of corners. Obviously, the stringers must be cut to required lengths and in some cases these cuts will be mitered to form corners, but beyond this the stringers should be in an assembly-ready condition for connection to the gables without additional machining.

Figure 11:
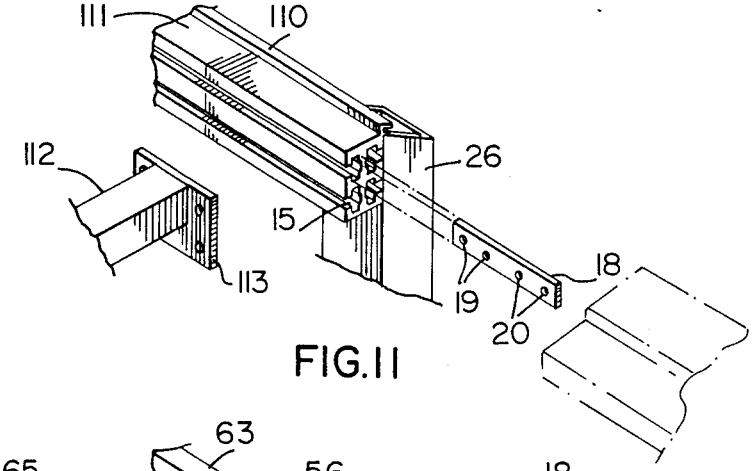
Figure 12:
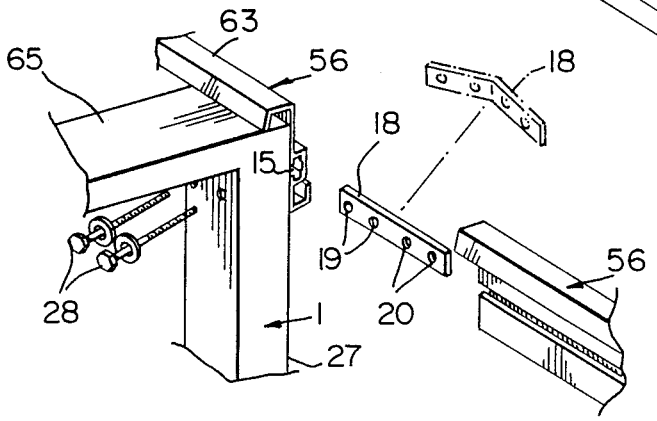

In a preferred embodiment constructed by the applicant, this may be accomplished by forming each stringer with at least one continuous laterally opening slot formed along the entire length of each stringer to accommodate sliding plate nuts. The nuts may be positioned at any point along the stringer to engage threaded fasteners joining the stringer to the gables. Reference is made to FIGS. 11 and 12 showing examples of such connections. The actual construction and purpose of each different stringer will be detailed below but each is formed in predetermined lengths of, for example, 30 to 96 inches and are simply cut, if necessary, to the required lengths upon assembly of the framework. Advantageously, the stringers may be formed by the extrusion of aluminum although other materials and means of forming are available.

Each stringer includes at least one continuous, longitudinally extending T-shaped slot 15 (FIG. 4) formed into its entire length. The down stroke 16 of the T opens laterally along the entire length of the extrusion, and obviously the transverse diameter of opening 16 is smaller than the transverse diameter of cross-stroke 17 which defines the T shape of the slot. A nut 18 having one or more threaded apertures 19 therein is slidably received into slot 15 and is positioned so that threaded fasteners such as bolts 28 can be used to connect the stringers to the gables, or to such other components as will be described. The nuts shown in FIGS. 11 and 12 include additional apertures 20 which facilitate the connection to an abutting stringer. Where a corner is formed, the nuts are simply bent to the required angle as shown in dotted lines, and the abutting ends of the stringers are mitered to the proper angle.

Figure 2:
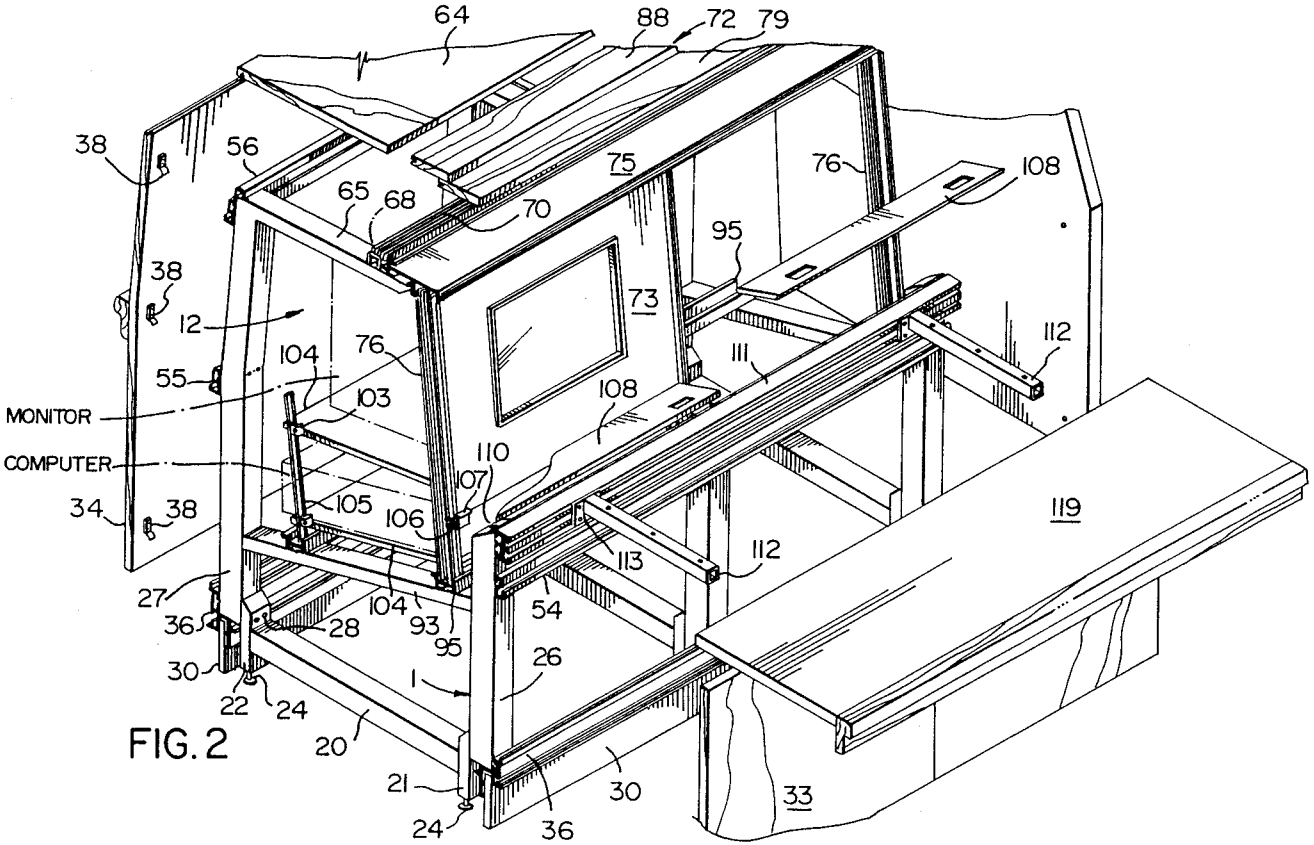
FIG. 2 is a perspective, partially exploded view of a low console structure as described herein.

With reference to FIGS. 1 and 2, each gable member 1 is defined by a horizontal cross member 20 extending between a vertical rear post 27, a vertical, usually somewhat shorter, front post 26, a cantilevered beam 65 extending forwardly from the upper end of rear post 27, and a crossbar 93 extending from rear post 27 to front post 26. In the embodiment shown, beam 65 and crossbar 93 taper from the rear post towards the front post to accommodate a monitor (broken lines) angled for viewing for an operator seated or standing before the console. As will become apparent, the angles at which these members incline, if any, may vary depending upon the manner in which the equipment supported therebetween is to be mounted.

As will be seen, a gap remains between the outer free ends of beams 65 and the top of front post 26 to define a forwardly opening space which extends continuously and without interruption along the length of the framework. This is important as it permits complete flexibility in the placement of equipment within the console without regard to the spacing between the gables themselves, or the positioning of the stringers.

Each gable may additionally include downwardly depending leg portions 21 and 22 having threadably adjustable feet 24 for leveling purposes.

It has been found advantageous to construct gables 1 of rectangular steel stock although other materials can obviously be used for this purpose.

Stringers 2 include a first stringer 36 which extends between the lower ends of both the front and rear posts 26 and 27 respectively of gables 1 along the length of the console structure and are joined to respective gables in the manner described above by means of bolts 28 engaging plate nuts (not shown) within slots 15. In the embodiment shown, bolts 28 may also serve to secure legs 21 and 22 in place although in most cases, the legs will simply be welded in place as an intrinsic part of each gable.

Figure 4:
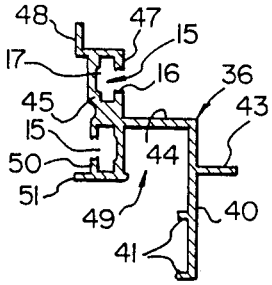
FIGS. 4 to 8 are cross-sectional views of stringers used in the console structure of FIG. 3.

As mentioned above, the stringers may also be adapted to support the finishing panels. With reference to FIG. 4, stringers 36 include a flange 48 and a bracket 49 to support, respectively, the lower ends of finishing panels 33 and 34 and baseboards 30. Clips 38 fastened along the lower ends of panels 33 and 34 hook over flanges 48 and the baseboards snap fit into bracket 49.

Each stringer 36 includes one slot 15 opening towards the gable post for connection thereto. A second slot 15 opening outwardly away from the posts may also be included to receive connecting splines 18 (FIGS. 11 and 12) or, if necessary, for positive connection between stringers 36 and finishing panels 33 and 34 using bolts.

Each stringer 36 also includes a bottom vertical arm 40 with lugs 41 on one side thereof for bearing against baseboard 30, and a ledge 43 on the other side thereof for ensuring proper spacing of the baseboards from legs 21 and 22. A horizontal web 44 connects the top end of the vertical arm 40 to a second vertical arm 45. The upper portion 47 of the arm 45 defines slot 15 for receiving nuts 18 and screws 28, and includes flange 48 for supporting the generally L-shaped clips 38 on the lower ends of the finishing panels 33 and 34. The lower portion 50 of vertical arm 45 defines the other slot 15 and the remaining arm of bracket 49 and includes a horizontal flange 51 for maintaining the bottom ends of the finishing panels 33 and 34 spaced apart from the baseboards. The top end of the front panel 33 is connected to post 26 by similar clips 38 which hook onto a stringer 54 connected to post 26 by fasteners 28.

Figure 5:
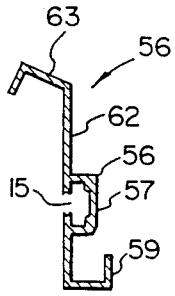

The upper end of rear finishing panel 34 is supported on rear post 27 by a second stringer 56 (FIG. 5). Stringer 56 includes a longitudinally extending T-slot 15 for receiving nuts 18 and fasteners 28 extending through post 27, and a flange 59 for engaging clips 38 along the upper edge of the panel 34. Vertical leg 62 of the stringer 56 extends upwardly to a generally L-shaped flange 63 which partially overlies beam 65 for supporting the rearward edge of a top finishing panel 64. Optional L-shaped brackets 66 on the bottom surface of panel 64 bear against top end 63 of the stringer 56 to limit rearward movement of such panel 64. The forward edge of finishing panel 64 may be spaced from cantilevered beam 65 by a stringer 68 extending between adjacent beams 65, and connected thereto by means of fasteners 28 received into T-slot 15. One edge of a ventilation grill 70 is provided at the forward edge of upper panel 64 to facilitate air circulation within the interior of the console and is also supported by stringer 68.

The forward edge of the grill, as well as a visor-like finishing strip 72 are supported by a third stringer 75 which interconnects the forward ends of cantilevered beams 65.

Figure 6:
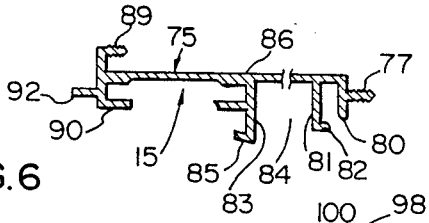
Figure 13:
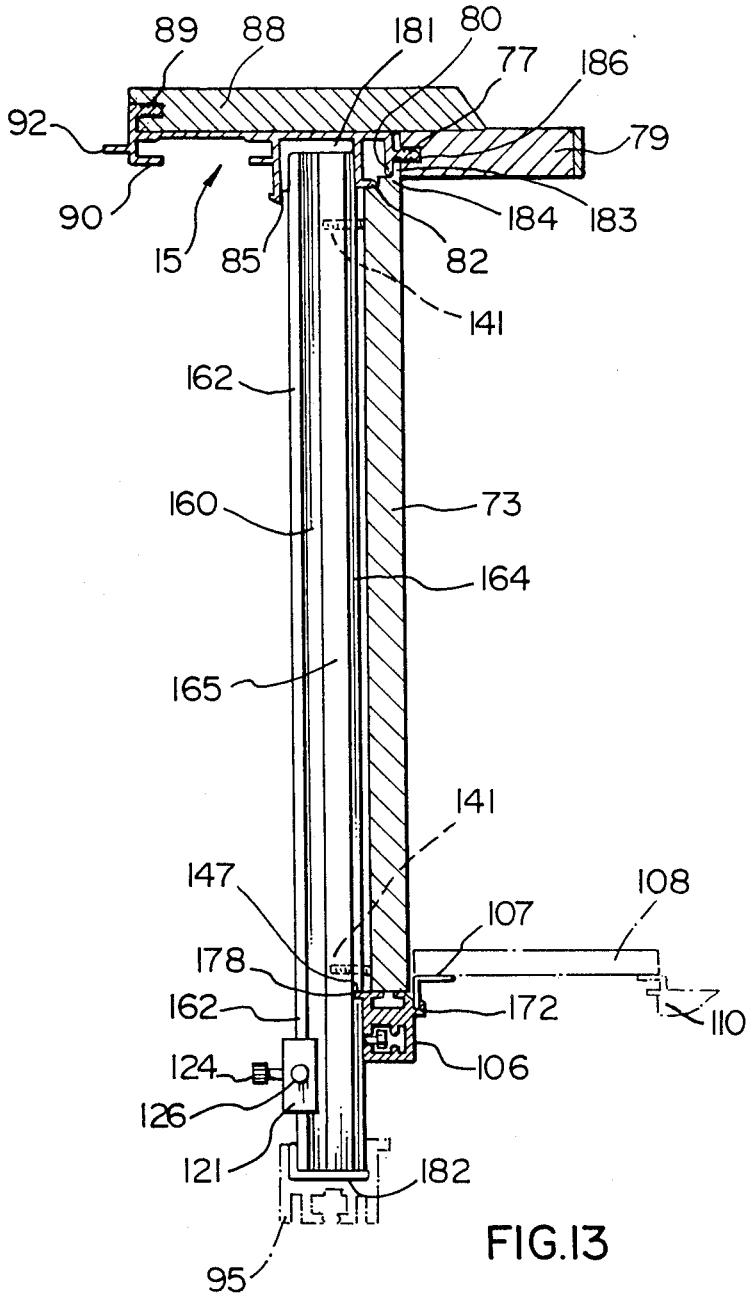
FIG. 13 is a side-elevational view showing the installation of a monitor facing panel.
Figure 14:
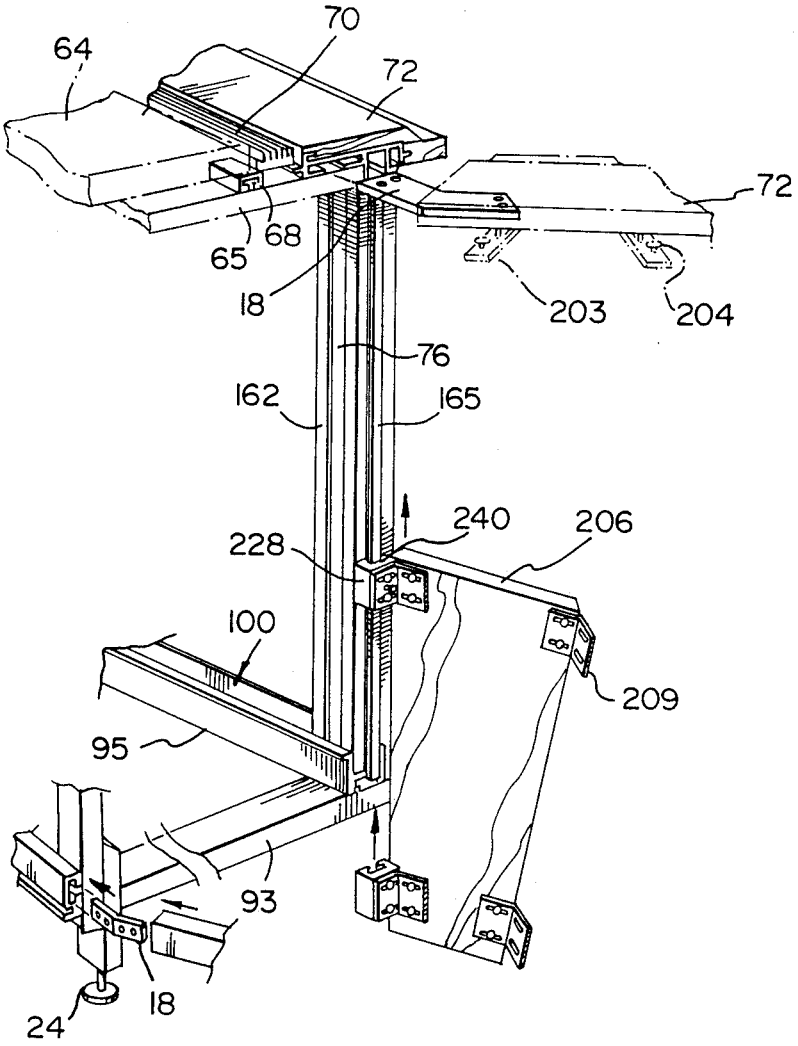
FIG. 14 is a partially exploded perspective view of a mitered corner junction between adjacent portions of the console framework.

With reference to FIG. 6, third stringer 75 includes a relatively wide T-shaped slot 15 to accommodate a wider spline or plate nut 18 seen most clearly in FIG. 14 which shows a mitered connection between adjacent gables defining a corner. The stringer includes ribbed forwardly extending flanges 77 and 89 for connection to the inner edges of overhangs 79 and 88, respectively, which together form finishing strip 72, the means of connection being seen most clearly in FIG. 13. A rearwardly extending ledge 92 supports the forward edge of ventilator grill 70. Adjacent to slot 15 stringer 75 includes a generally rectangular-shaped downwardly opening channel 84 defined by vertical legs 81 and 83 and horizontal web 86. Channel 84 is intended to slidably engage the upper ends of upright support members 76 which will be described in greater detail below. Vertical leg 81 includes a forwardly projecting lug 82, and forwardly of leg 81 another shorter vertical leg 80 subtends from web 86. Lug 82 and leg 80 co-operate with finishing strip 72 to support the upper end of a monitor facing panel 73 as will be described below.

A fourth stringer 54 is connected adjacent the upper ends of front posts 26 of gables 1, and as aforesaid, the stringer is intended primarily to support the upper edges of front finishing panels 33. The cross-sectional shape of the fourth stringer is the same as that of the second stringer as shown in FIG. 5 and includes a T-shaped slot 15 and a flange 59 but obviously does not include either leg 62 or overhang 63. In some instances, another stringer 55, or at least short lengths thereof, similar to stringers 54 may be mounted on the rear posts 27 at an intermediate point between the first and second stringers to provide additional support for rear panel 34.

A work surface or shelf is a normal requirement for most console structures. In addition to providing a space for paperwork, users often require that computer keyboards, switch plates, telephone mounts and other pieces of equipment be countersunk into the work surface. It is important however that even this component of the console be assembled from standardized components permitting maximum flexibility of installation and requiring little or no custom machining of the necessary supports.

Figure 8:
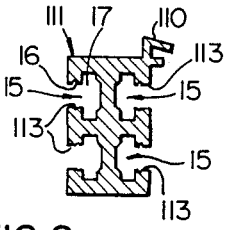

With reference to FIG. 2, shelf 119 representing a work surface is supported by a plurality of spaced apart shelf supports 112 connected to and extending orthogonally outwardly from a shelf support stringer 111. Stringer 111 extends between the upper ends of front posts 26 and is shown in cross-section in FIG. 8. The stringer includes at least one and preferably two T-slots 15 opening towards the front posts to receive threaded fasteners 28 joining the two. As before, the slots receive plate nuts to which fasteners 28 are threaded. At least one and preferably two additional T-slots 15 open away from the posts to receive fasteners connecting shelf supports 112 to the stringer. Each shelf support includes an apertured plate 113 which abuts the outer surface of stringer 111 and through which the fasteners pass to engage the plate nuts within the T-slots. As will be appreciated, the spacing between adjacent shelf supports 112 is completely flexible in the event, for example, that a greater spacing is required to accommodate an unusually wide countersunk keyboard or control panel. Shelf 119 simply overlies stringer 111 and supports 112 and may be secured thereto by means of screws threaded upwardly through holes in the supports into the lower surface of the shelf 119.

The inner upper edge of stringer 111 may include a lug 110 to support one edge of an access insert panel 108 to be described below.

As will be seen most clearly from FIG. 2, assembly of gables 1 and stringers 2 results in a console framework having a substantially unimpeded and continuous cavity 12 available for installation of different pieces of equipment at any location without regard to the placement or spacing between the gables, and the interconnecting stringers. A number of means of supporting equipment within the cavity will occur to those skilled in the art, and one such means developed by the applicant will be described with reference to FIGS. 2 and 3.

Video monitors are one of the bulkier pieces of equipment commonly installed within the console, and because such monitors vary considerably in overall dimensions from one make to another, it has been found advantageous to support the monitors on an adjustable platform whereby the height and angle of inclination of the monitor can be varied.

With reference to FIG. 2, the platform means for the monitor comprises generally a platform 104 supported at each of its forward corners by means of a pivotally connected set screw clamp 103 (seen most clearly in FIG. 9) slidably mounted for up and down movement on respective vertical equipment supports 76, and supported at each of its rear corners by means of similar set screw clamps 103 slidably mounted for up and down movement on respective equipment supports 105. Obviously, this arrangement permits adjustments to the height and attitude of platform 104 to provide maximum flexibility so that the monitor can be angled backwards and forwards and, to a certain extent, side to side (primarily for leveling purposes).

Figure 7:
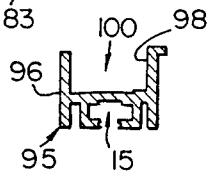

The lower ends of vertical equipment supports 76 and 105 are received into channel-shaped stringers 95 which extend between crossbars 93 adjacent front and rear posts 26 and 27, respectively. With reference to FIG. 7, stringers 95 include the usual T-slot 15 for connection to the crossbars by means of threaded fasteners and plate nuts positioned within the slot, and an oppositely facing generally rectangular channel 100 defined by vertical lugs 96 and 98.

The upper ends of equipment supports 105 are unrestrained to permit the pivoting movement necessary to accommodate changes in the angle of inclination of platform 104. The upper ends of vertical support 76 on the other hand are received into channels 84 in third stringers 75. Supports 76 and 105 are slidably received into channels 84 and 100 so that they may be easily laterally positioned, or repositioned, to provide the necessary spacing therebetween whenever required, which again contributes to the flexibility of the present framework.

The ends of vertical supports 76 in particular may include plastic or nylon caps 181 and 182 (FIG. 3) for a more "compressive" fit within channels 84 and 100.

Figure 3:
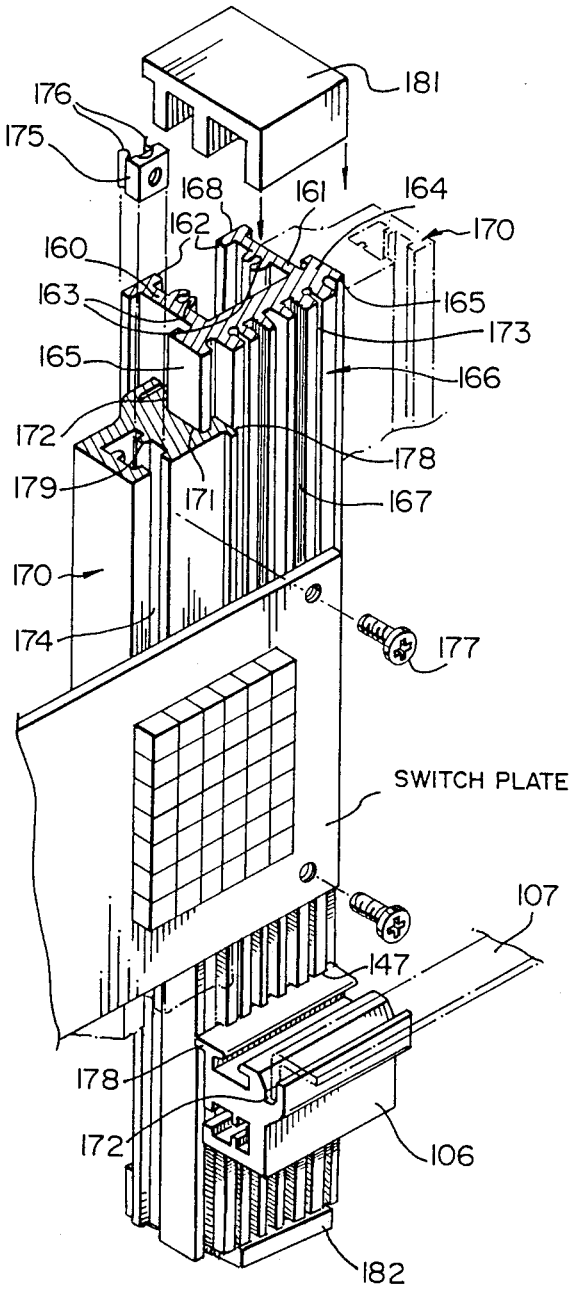
FIG. 3 is a perspective, partially cutaway view of an equipment rack mount used on the console structure of FIG. 2.
Figure 9:
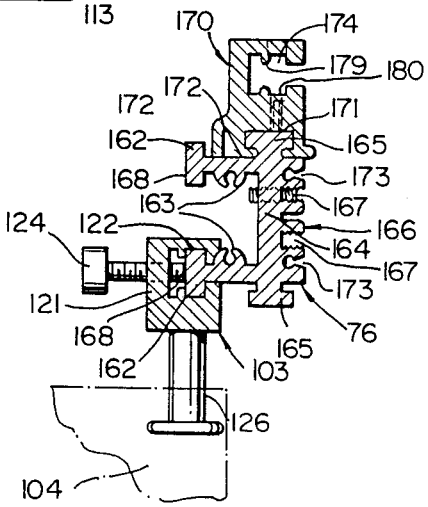
FIG. 9 is a cross-sectional view of a vertical equipment support with attachments.

Vertical supports 76 will now be described in greater detail with reference to FIGS. 3 and 9. Each support includes two rearwardly extending legs 160 and 161 defining a generally rectangular channel therebetween, each leg including at its outer end a T-shaped flange 162 and having on its inner surface a longitudinally extending bead 163. Legs 160 and 161 are interconnected by a web 164 including along opposite lateral edges thereof T-shaped flanges 165 and in the forward surface 166 thereof, at least one and more typically two (or more) ribbed slots 167 and key-hole slots 173. Key hole slots 173 are intended to receive self tapping screws used to mount relatively light panels and pieces of equipment to vertical supports 76.

A plurality of set screws 141 (FIG. 13) threaded into slots 167 through web 164 for tightening against the back of monitor facing panel 73. As will be described, the set screws push the facing panel against restraints located at upper and lower ends of the panel for tightening it in place.

T-flanges 162 slidably engage set screw clamps 103 pivotally connected to the forward corners of platform 104. Each clamp includes a body 121 having a longitudinally extending T-shaped slot 122 therein to mate with T-flanges 162, a set-screw 124 threadably received through the body, and a cylindrical pin 126 for pivotal connection to platform 104. Set screw 124 tightens against a rear surface 168 of the flanges 162 to hold the clamp in its adjusted position.

Some equipment rather than being supported by a platform is more advantageously mounted by cantilevering the same from vertical supports 76. Such equipment might include switch panels, control boxes, telephone mounts and other "rack mount" applications. Fasteners threaded into slots 173 may not provide the necessary strength for such mounts, particularly if supports 76 are made of aluminum and mullions 170 may therefore be added, an example of which is again seen most clearly in FIGS. 3 and 9. Each mullion 170 as shown includes a first T-slot 171 to slidably engage T-flange 165 on one side of support 76, and a set screw 180 for tightening against flange 165 to hold the mullion more securely in a fixed vertical position. A second T-slot 174 is formed in the forward surface of the mullion to slidably receive therein cage nuts 175. The nuts are positioned to receive threaded fasteners 177 for securing the rack mounts as shown. The cage nuts may be provided with resilient flanges 176 frictionally biased against inner flanges 179 so that the nuts will hold their vertical position until engaged by the fasteners. Other mullion shapes are of course possible, including standalone units, or, in the alternative, supports 76 may be formed to include the mullions as an integral part thereof.

When the equipment has been mounted within the console, monitor facing 73 is installed in the manner seen most clearly with reference to FIGS. 2 and 13. The lower edge of panel 73 is supported by a bracket 106 which in the embodiment constructed by the applicant is simply a suitable length of mullion 170 turned on its side and bolted to support 76 as shown. A transverse groove 147 is formed a ross surface 166 of support 76 to provide clearance for lug 178 on the bracket thereby permitting a flush fit of the bracket against surface 166. Bracket 106 includes a linear groove 172 formed forwardly of the front surface of the monitor facing to receive an L-shaped flange 107, which co-operates with surface 166 to form a channel into which the lower edge of facing 73 is received. The flange also supports the rearward edge of a removable access panel 108, the forward edge of which is supported by lug 110 on shelf support stringer 111. The space beneath the access panels provides access to equipment or controls mounted beneath the monitors, or may be lined or finished to serve as a convenient storage space for small items.

The upper edge of facing 73 is stepped as shown in FIG. 13 to include a tongue 183 and a shoulder 184. When installed, tongue 183 fits into a correspondingly sized slot 186 formed between the rearward edge of visor 79 and the forward surface of vertical leg 80 on stringer 75, and shoulder 184 abuts against lug 82 on leg 81. The resulting fit holds the upper edge of the facing panel, and forms an aesthetically pleasing corner fit between the facing 73 and the visor. Set screws 141 in support 76 are tightened against the rear of the facing forcing it against flange 107 at the bottom and visor 79 at the top to take up any looseness in the fit and to prevent vibration.

The remaining finishing panels are mounted as indicated in FIG. 2 by hooking attached clips 38 over the cooperating flanges on the stringers. End panels 193 may be screwed or bolted directly onto the gables at each end of the console structure.

The console structure substantially as described above is readily adaptable to the formation of corners such as those indicated generally at 200 in FIG. 1. One possible construction for such a corner is shown with reference to FIGS. 10 and 14 wherein like numerals have been used to denote the same elements appearing in the other drawings. The construction of the corner will be self-evident from a review of FIGS. 10 and 14. Each of the stringers apart from shelf support stringer 111 is suitably mitered at their respective abutting ends and connected together using correspondingly angled splines 18. Finishing strip 72, ventilator 70 and upper finishing panel 64 are also suitably mitered to the correct angle. Ventilator 70 and the forward edge of finishing panel 64 are supported by means of a bottom bracket 203 connected at one end thereof to the underside of strip 72 by means of screws or bolts, and including at its other end a suitable retainer 204 for supporting the forward edge of top panel 64. A facia 206 is also required and this may be supported by set screw clamps 228 formed with suitable T-slots 240 for slidably engaging T-flanges 165 on supports 76, and suitably angled flanges 209 with slots formed therein for fasteners connecting the clamps to the rear surface of the facia and to clamp 228 as shown.

Figure 10:
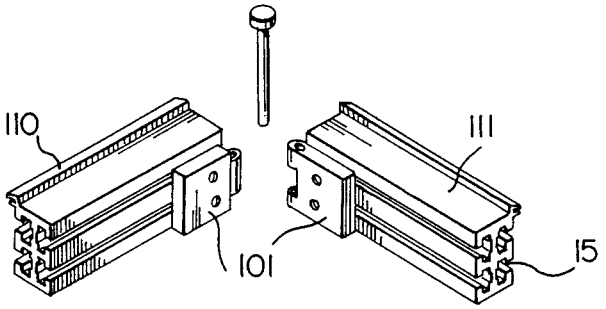
FIGS. 10, 11 and 12 are perspective views of different connections between the stringers.

Shelf support stringers 111, rather than being mitered, are most conveniently hinged together at the corner as shown most clearly in FIG. 10 by means of a hinge 101.

Other console structures are possible using the principles substantially as outlined above.

Figure 15:
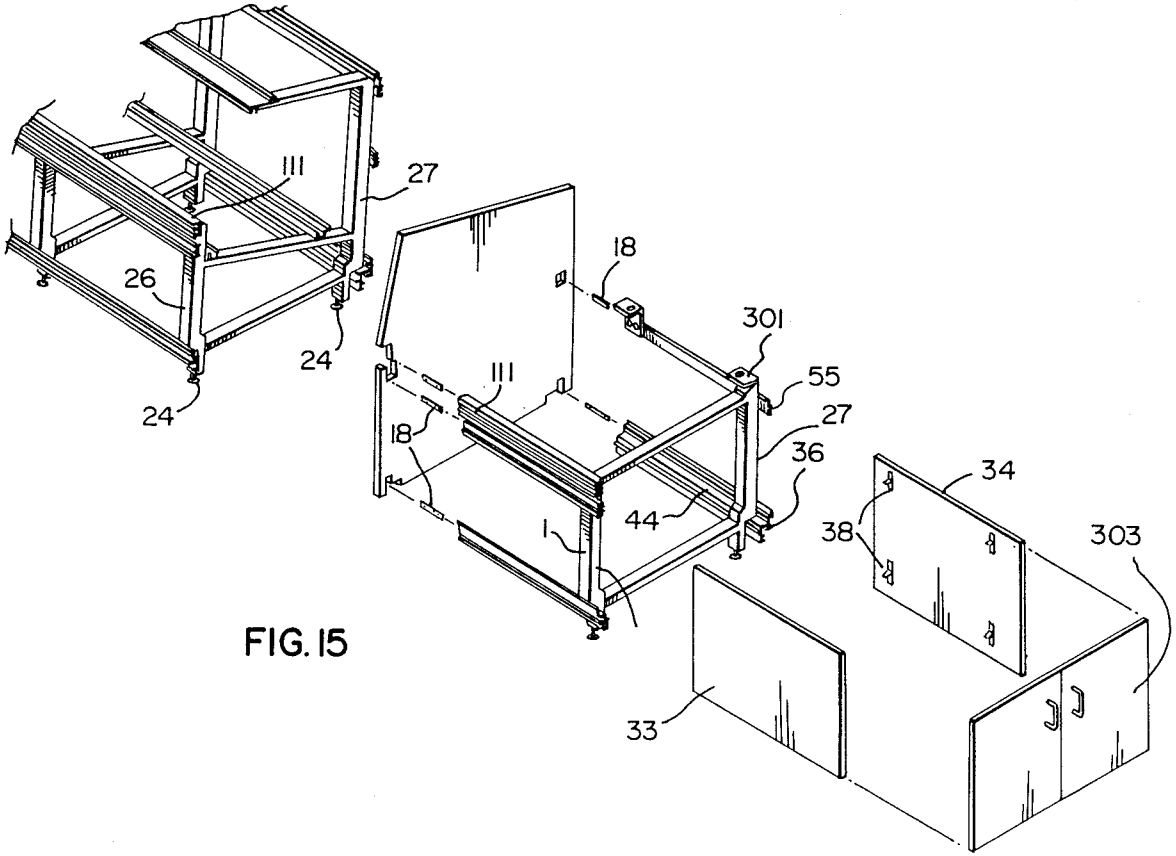
FIG. 15 is a perspective partially exploded view of a countertop/cabinet unit.

For example, with reference to FIG. 15, there is shown a countertop/cabinet unit. Again like numerals are used to denote like elements. Gables 1 are chopped off so that front and rear posts 26 and 27 are of equal length and brackets 301 are added to support the countertop/work surface 208 (FIG. 1). A cabinet bottom surface (not shown) may be supported on webs 44 of first stringers 36, and cabinet doors 303 may be installed in place of the usual end panels.

Figure 16:
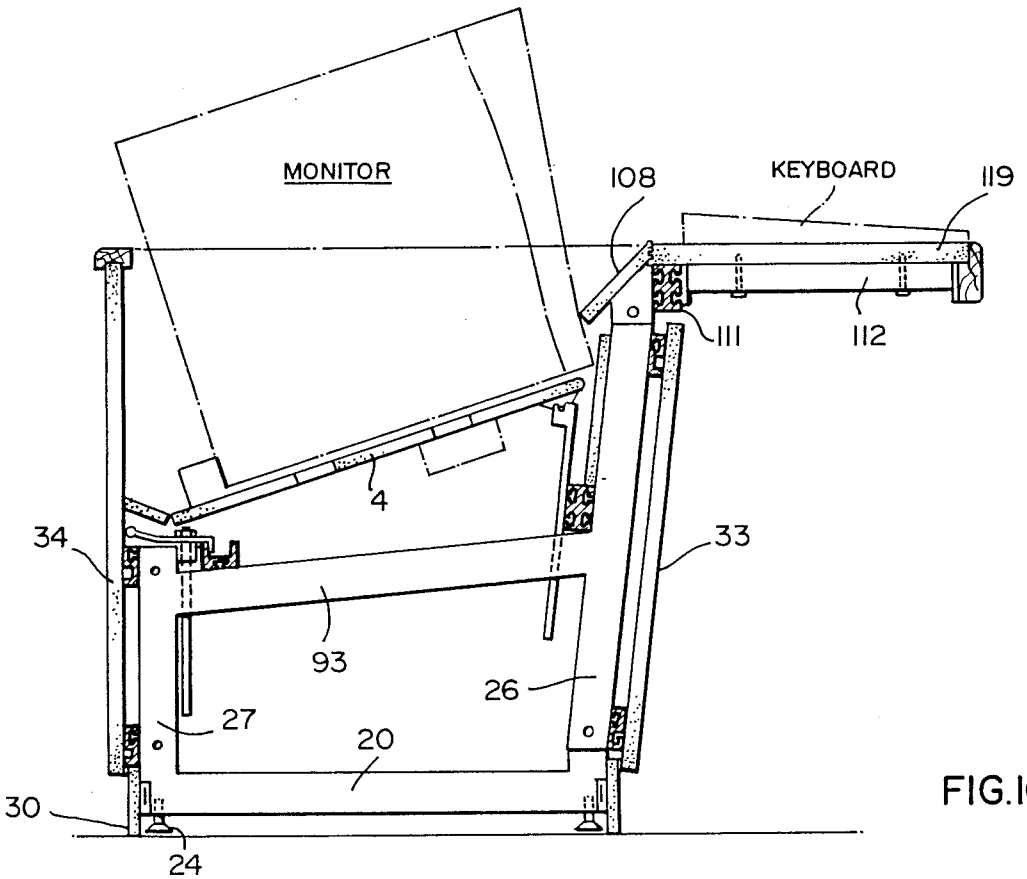
FIG. 16 is a side elevational view of a variation of the console structure described herein.

With reference to FIG. 16, there is shown diagrammatically yet another possible mount for a video monitor using essentially the same components as described above.

Figure 17:
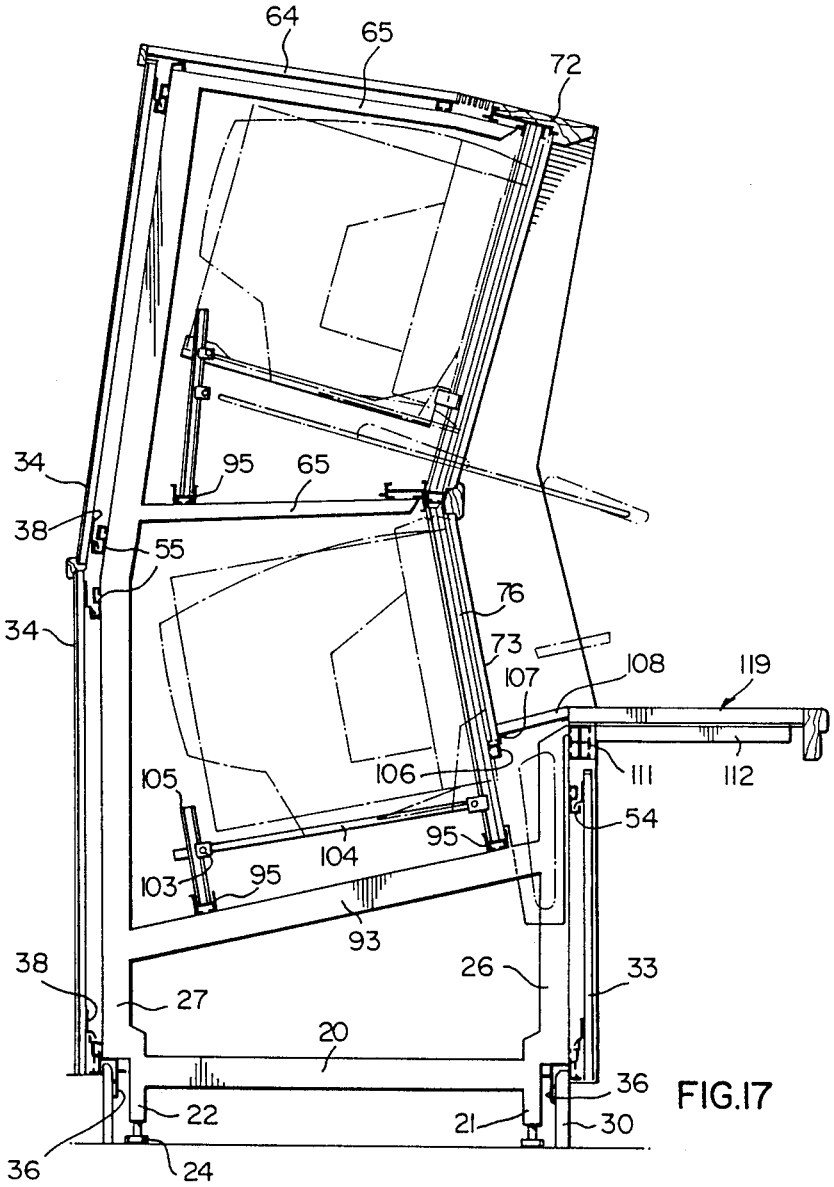
FIG. 17 is a side elevational view of another variation to the console structure to support superimposed pieces of equipment.

Yet another possibility is shown with reference to FIG. 17 illustrating a double height console structure for superimposed pieces of equipment, and it will be apparent from the foregoing that many other variations are possible using the gable and stringers described above, subject of course to slight modifications depending upon the exact nature of the required framework. The principles of construction, and the resulting flexibility of the framework remain the same however.

It is of course possible to construct a console structure using the present gables and stringers formed without T-shaped slots but which are merely screwed or bolted to the gables in the ordinary way. This may however limit the flexibility of the resulting structure, and requires of course some additional machining of the stringers primarily to form holes for the fasteners.

Although preferred embodiments of the invention have been described in considerable detail for illustrative purposes, many modifications will occur to those skilled in the art without departing from the inventive scope of the present invention which is limited only by the true scope of the appended claims.

I claim:

1. A console structure for supporting one or more pieces of equipment, comprising:

a plurality of horizontally-spaced, vertically upright gable members each of said gable members including a lower substantially horizontal cross member, rear post means extending upwardly from one end of said cross member, front post means extending upwardly from the other end of said lower cross member, a cantilevered beam extending forwardly from the upper end of said rear post means, leaving a gap between the forward end of said cantilevered beam and the upper end of said front post means, and crossbar means extending between said front and rear post means, stringer means interconnecting said gable members to provide a self-supporting structure defining therein a continuous unobstructed cavity within which at least some of said pieces of equipment may be supported, said stringer means including therein at least one continuous longitudinally extending alot adapted for connection to fastening means joining said stringer means to said gable members, and means for supporting said pieces of equipment within said cavity.

2. The console structure of claim 1 wherein said supporting means for said pieces of equipment include a plurality of generally upright, horizontally-spaced equipment support members slidably supported for horizontal movement in said gap between the forward ends of said cantilevered beams and the upper ends of said front post means of said gable members.

3. The console structure of claim 2 wherein said stringer means include at least one surface facing outwardly relative to said gable members for supporting external finishing panels for said console structure.

4. The console structure of claim 3 wherein said stringer means include a first string extending between the lower ends of adjacent rear post means and the lower ends of adjacent front post means, said outwardly facing surface of said first stringer means comprising a flange for supporting the lower ends of front and rear finishing panels, respectively.

5. The console structure of claim 4 wherein said first stringer further includes downwardly extending leg means defining a generally inverted U-shaped bracket for frictionally engaging a finishing panel comprising a protective baseboard member.

6. The console structure of claim 4 wherein said stringer means include a second stringer interconnecting the upper ends of adjacent ones of said rear post means, said second stringer including flange means for supporting the upper ends of said rear finishing panels.

7. The console structure of claim 6 wherein said second stringer includes a forwardly extending flange partially overlying said cantilevered beam to support one edge of an upper finishing panel.

8. The console structure of claim 7 wherein said stringer means include a third stringer interconnecting said forward ends of adjacent ones of said cantilevered beams, said third stringer including flange means for supporting another edge of said upper finishing panel, and for mounting a finishing strip on said console structure.

9. The console structure of claim 8 wherein said stinger means include a fourth stringer connected to said front post means adjacent the upper ends thereof, said outwardly facing surface of said fourth stringer including a flange for supporting an upper end of said front finishing panels.

10. The console structure of claim 9 wherein said stringer means include a fifth stringer connected to said rear post means at a point between said first and second stringers, said outwardly facing surface of said fifth stringer including a flange for supporting said rear finishing panels.

11. The console structure of claim 9 wherein said stringer means include a shelf supporting stringer interconnecting the upper ends of adjacent ones of said front post means, said supporting stringer including at least one additional of said slots formed in said outwardly facing surface thereof for connection to fastening means joining said supporting stringer to orthogonally extending shelf support members, said supporting stringer and said shelf support members cooperating to define a support for a planar work surface.

12. The console structure of claim 11 wherein said fastening means include threaded nut means slidably disposed within said slots in said stringer means and correspondingly threaded bolt means which pass through a portion of said slot to engage said nut means.

13. The console structure of claim 12 wherein said slots in said stringer means are T-shaped in cross-sectional configuration, said nut means being slidably disposed in the cross stroke of the T, and said bolt means passing through the down-stroke thereof which opens laterally along the length of said stringer means.

14. The console structure of claim 13 wherein said threaded nut means are resiliently biased into frictional engagement with said T-shaped slot.

15. The console structure of claim 13 wherein said threaded nut means include resilient means biased against said slot for frictionally retaining said threaded nut means in a predetermined position along the length of said connecting member.

16. The console structure of claim 13 wherein said stringer means is a metal extrusion.

17. The console structure of claim 13 herein said stringer means include said T-shaped slots on opposite sides thereof.

18. The console structure of claim 2 including first elongate channel means extending between said crossbars of adjacent gable members, said channel means including on one side thereof a continuous longitudinally extending slot adapted for connection to fastening means joining said channel means to respective ones of said crossbars at a point proximal to said front post means, and on an opposite side thereof a continuous longitudinally extending generally rectangular channel opening upwardly towards said forward ends of said cantilevered beams.

19. The console structure of claim including second elongate channel means extending between said forward ends of adjacent ones of said centilevered beams and having therein a continuous longitudinally extending generally rectangular channel opening downwardly in a direction towards said channel in said first channel

20. The console structure of claim wherein the lower ends of said equipment support members are slidably received in said first channel means, and the upper ends of said support members are slidably received in said downwardly opening second channel means.

21. The console structure of claim 20 further including mullion means connectable to said equipment support members laterally thereof, said mullion means including therein a continuous longitudinally extending slot adapted for connection to fastening means joining said mullion means to a facing member supported thereby.

22. The console structure of claim 21 wherein each of said vertical support members includes therein a plurality of parallel longitudinally extending grooves adapted to receive therein fastening means connecting said support members to a monitor facing panel and other objects to be supported thereby.

23. The console structure of claim 22 further including platform means mounted within said cavity for supporting a piece of equipment adjacent said forwardly opening gaps between the forward ends of said cantilevered beams, and the upper ends of said front post means.

24. The console structure of claim 23 wherein said platform means are supported to be adjustable in height and angle of incline relative to said gable members.

25. The console structure of claim 24 wherein said platform means are adjustably supported at a forward edge thereof by said equipment support members.

26. The console structure of claim 25 wherein said platform means include at said forward edge thereof clamp members pivotally connected thereto, said clamp members being adapted for connection to respective ones of said equipment support members for up and down movement therealong.

27. The console structure of claim 20 wherein said crossbar tapers downwardly from said front post means to said rear post means.

28. The console structure of claim 20 wherein said cantilevered beam is inclined at an angle relative to the horizontal.

29. A console structure for supporting one or more pieces of equipment, comprising:

a plurality of horizontally-spaced, vertically upright gable members, each of said gable members including a lower substantially horizontal cross member, rear post means extending upwardly from one end of said cross member, front post means extending upwardly from the other end of said lower cross member, a cantilevered beam extending forwardly from the upper end of said rear post means, leaving a gap between the forward end of said cantilevered beam and the upper end of said front post means, and crossbar means extending between said front and rear post means, stringer means interconnecting said gable members to provide a self-supporting structure defining therein a continuous unobstructed cavity within which at least some of said pieces of equipment may be supported, said stringer means including therein at least one continuous longitudinally extending slot adapted for connection to fastening means joining said stringer means to said gable members, means for supporting said pieces of equipment within said cavity;

said stringer means including at least one surface facing outwardly relative to said gable members for supporting external finishing panels for said console structure and further including a first stringer extending between the lower end of adjacent rear post means and the lower ends of adjacent front post means, said outwardly facing surface of said first stringer means comprising a flange for supporting the lower ends of front and rear finishing panels, respectively, said first stringer further including downwardly extending leg means defining a generally inverted U-shaped bracket for frictionally engaging a finishing panel comprising a protective baseboard member; and second stringer means interconnecting the upper ends of adjacent ones of said rear post means, said second stringer including flange means for supporting the upper ends of said rear finishing panels, said second stringer further including a forwardly extending flange partially overlying said cantilevered beam to support one edge of an upper finishing panel.

30. A console structure for supporting one or more pieces of equipment, comprising:

a plurality of horizontally-spaced, vertically upright gable members, each of said gable members including a lower substantially horizontal cross member, rear post means extending upwardly from one end of said cross member, front post means extending upwardly from the other end of said lower cross member, a cantilevered beam extending forwardly from the upper end of said rear post means, leaving a gap between the forward end of said cantilevered beam and the upper end of said front post means, and crossbar means extending between said front and rear post means, stringer means interconnecting said gable members to provide a self-supporting structure defining therein a continuous unobstructed cavity within which at least some of said pieces of equipment may be supported, said stringer means including therein at least one continuous longitudinally extending slot adapted for connection to fastening means joining said stringer means to said gable members, and means for supporting said pieces of equipment within said cavity, said means for supporting including:

(a) a plurality of generally upright, horizontally-spaced equipment support members slidably supported for horizontal movement in said gap between the forward ends of said cantilevered beams and the upper ends of said front post means of said gable members; and (b) platform means mounted within said cavity for supporting a piece of equipment adjacent said gap between the forward ends of said cantilevered beams and the upper ends of said front post means of said gable members.

* * * * *